US005154129A

United States Patent [19]

Schips

[11] Patent Number: 5,154,129

[45] Date of Patent: Oct. 13, 1992

[54] AUTOMATIC SEWING MACHINE FOR SEWING CHAIN STITCH SEAMS

[76] Inventor: Helmut Schips, Klosterweidlistrasse, CH-9010 St. Gallen, Switzerland

[21] Appl. No.: 628,907

[22] Filed: Dec. 18, 1990

[30] Foreign Application Priority Data

Dec. 19, 1989 [EP] European Pat. Off. ..... 89 123 499.9

[51] Int. Cl.[5] ..... D05B 1/06; D05B 75/00

[52] U.S. Cl. ..... 112/197; 112/260

[58] Field of Search ..... 112/197, 260, 451, 317

[56] References Cited

U.S. PATENT DOCUMENTS

| | | | |
|---|---|---|---|
| 3,100,469 | 8/1963 | Washburn . | |
| 3,257,979 | 6/1966 | Michaud | 112/260 X |
| 3,358,631 | 12/1967 | Sharp | 112/260 |
| 4,493,280 | 1/1985 | Bianchi | 112/260 |
| 4,546,716 | 10/1985 | Babson et al. | 112/260 X |
| 4,644,884 | 2/1987 | Tatsumi | 112/130 |
| 4,969,409 | 11/1990 | Nakano | 112/197 X |

FOREIGN PATENT DOCUMENTS

| | | |
|---|---|---|
| 1933678 | 1/1971 | Fed. Rep. of Germany . |
| 2825530 | 5/1987 | Fed. Rep. of Germany . |
| 37444 | 10/1981 | Japan . |

*Primary Examiner*—Werner H. Schroeder
*Assistant Examiner*—Paul C. Lewis
*Attorney, Agent, or Firm*—Dickstein, Shapiro & Morin

[57] ABSTRACT

An automatic sewing machine for sewing chain stitch seams is suitable both for forward sewing and for reverse sewing. For forming chaining loops, a chaining tongue is to be disposed in the region of the needle. During forward sewing, the chaining tongue disposed on the needle plate is directed in the feeding direction. This chaining tongue (32) for forward sewing, just as a chaining tongue (34) for reverse sewing, is formed on a disk-shaped tongue carrier (30) which is embedded in the needle plate (22). The disk-shaped tongue carrier (30) is brought, via an adjusting mechanism (40 to 57), into one of two defined operational positions corresponding to forward sewing and reverse sewing, respectively. A sewing material feeder is formed as a gripper-type feeder having upper a lower gripping structures (60, 62). The lower gripping structure (60) is guided in a guide way (36) of the needle plate across the tongue carrier (30).

13 Claims, 1 Drawing Sheet

AUTOMATIC SEWING MACHINE FOR SEWING CHAIN STITCH SEAMS

The invention relates to an automatic sewing machine for sewing chain stitch seams.

For sewing looped or chain stitch seams, for instance overlock, interlock and flatlock seams, conventional automatic sewing machines have, fixedly integrated in the needle plate, a chaining tongue for forward sewing which is directed in the sewing transporting direction and renders possible the formation of the chain loops. Transportation of the sewing material is effected by means of various, generally used and known feeding means. The edges of the upper and the lower material to be sewn are cut to be flush by means of an edge cutting device. To this end a lower knife of the edge cutting device is fixed on the machine. An upper knife moves in cycle with respect to the sewing machine needle. A chain catcher sucks in, by means of air, the thread chain or loop cut off at the last piece and retains the same. At the beginning of the sewing operation, the thus retained thread chain is sewn into the newly formed seam, and the seam beginning is thus sewn on.

With this method, the production of complete chain stitch seams turns out to be particularly complex and time-consuming since the thread chain at the seam end must be locked or sewn on in a separate operational step using a specific machine or since it is troublesome to reverse the sewing material before locking can take place. The main cause for the difficulties mentioned is the fact that in the automatic sewing machines usual so far, only forward sewing was possible due to the rigid arrangement of the chaining tongue in the needle plate and the edge cutting device and due to the means suitable for forward feeding only.

It is the object of the invention to provide an automatic sewing machine for sewing chain stitch seams of the type indicated at the outset, which renders possible reverse sewing as well.

This object is met by the present invention.

According to the invention, the chaining tongue is not fixed on the needle plate, as was usual with former machines, but rather a movable chaining tongue carrier having two chaining tongues and being integrated in the needle plate is employed, so that there is the possibility of employing one chaining tongue for forward sewing and one for reverse sewing. Together with a correspondingly designed feeding means and thread guide means, sewing can thus be carried out in forward direction as well as in reverse direction.

This is particularly advantageous at the beginning and at the end of a loop or chain stitch seam. At the seam beginning, locking of the seam can be carried out in that reverse sewing is carried out first at a certain distance from the sewing material edge and, thereafter when the sewing material edge is reached, the operation is changed over to forward sewing. Thus, the chain catcher mentioned hereinbefore is not cogently necessary any more. For locking the seam end, sewing in reverse direction is carried out at the end over a short distance. It is also possible to start at the sewing material edge and to sew at first in forward direction over a distance of approx. 10 to 15 mm and then in reverse direction back to the sewing material edge, whereafter sewing is carried out until the other sewing material edge is reached, where the seam is again neatened or finished by reverse sewing over a distance of 10 to 15 mm.

As a thread guide means for reverse sewing, there is provided an auxiliary chaining tongue above the needle plate.

Due to the fact that the complete chain stitch seam can be manufactured in a short period of time without additional operations by means of a separate machine, the time required so far for making a chain stitch seam is reduced considerably.

According to an embodiment of the invention, there is provided a linearly adjustable tongue carrier in the needle plate, with said tongue carrier containing two chaining tongues which are directed towards each other and located approximately on one line and whose apexes have a predetermined distance from each other, with these apexes being adapted to be selectively positioned at the level of the needle plate recess.

In another embodiment the needle plate supports a disk-shaped tongue carrier which is rotatable about a rotational axis or hinge pin perpendicular to the needle plate plane in a defined angular range. This disk-shaped tongue carrier carries in its peripheral portion the two chaining tongues whose apexes are directed towards each other and which are each located in an end position of the afore-mentioned angular range in a position for forward sewing or reverse sewing, respectively.

Adjustment of the tongue carrier is effected with the aid of an adjusting mechanism which, by means of a linkage system, moves a toothed segment that is directly or indirectly engaged with a toothed means on the tongue carrier. The two operating positions of the chaining tongues are defined by stops of the adjusting mechanism. A further embodiment provides to drive the tongue carrier directly via a shaft by a pneumatic rotational drive or a rotational magnet and to rotate the same about an exactly defined rotational angle.

Of specific importance in the automatic sewing machine according to the invention is the sewing material feeding or conveying means. An embodiment of the invention provides for this sewing material feeding means a linear gripper-type feed independent of the machine. With this feed type, the sewing material is clamped between the lower and the upper gripping part. The upper and the lower gripping part are attached to a support which is supported on a shaft via ball guides. Feeding of the sewing material is effected via a d.c. motor which, via a toothed belt, linearly displaces said support together with the lower and upper gripping parts and the fabric clamped therebetween. The lower gripping part is supported in the guide of the needle plate and the upper gripping part is lowered and raised by means of a pneumatic cylinder. Switching over from forward to reverse sewing, as well as lifting and lowering of the movable upper gripping part, through which the sewing material is clamped, are carried out via the control system of the machine.

A further important aspect for reverse sewing is the retractable lower knife of the edge cutting device. When the machine control switches over to reverse sewing, the lower knife of the edge cutting device is automatically retracted by a pneumatic cylinder, since otherwise the already produced seam would be destroyed again by the edge cutting device upon reverse sewing.

BRIEF DESCRIPTION OF THE DRAWINGS

Embodiments of the invention will be elucidated in more detail hereinafter with reference to the drawings in which.

DETAILED DESCRIPTION OF THE PREFERRED EMBODIMENTS

Figures 1A, 1B, 2A, 2B, 3:
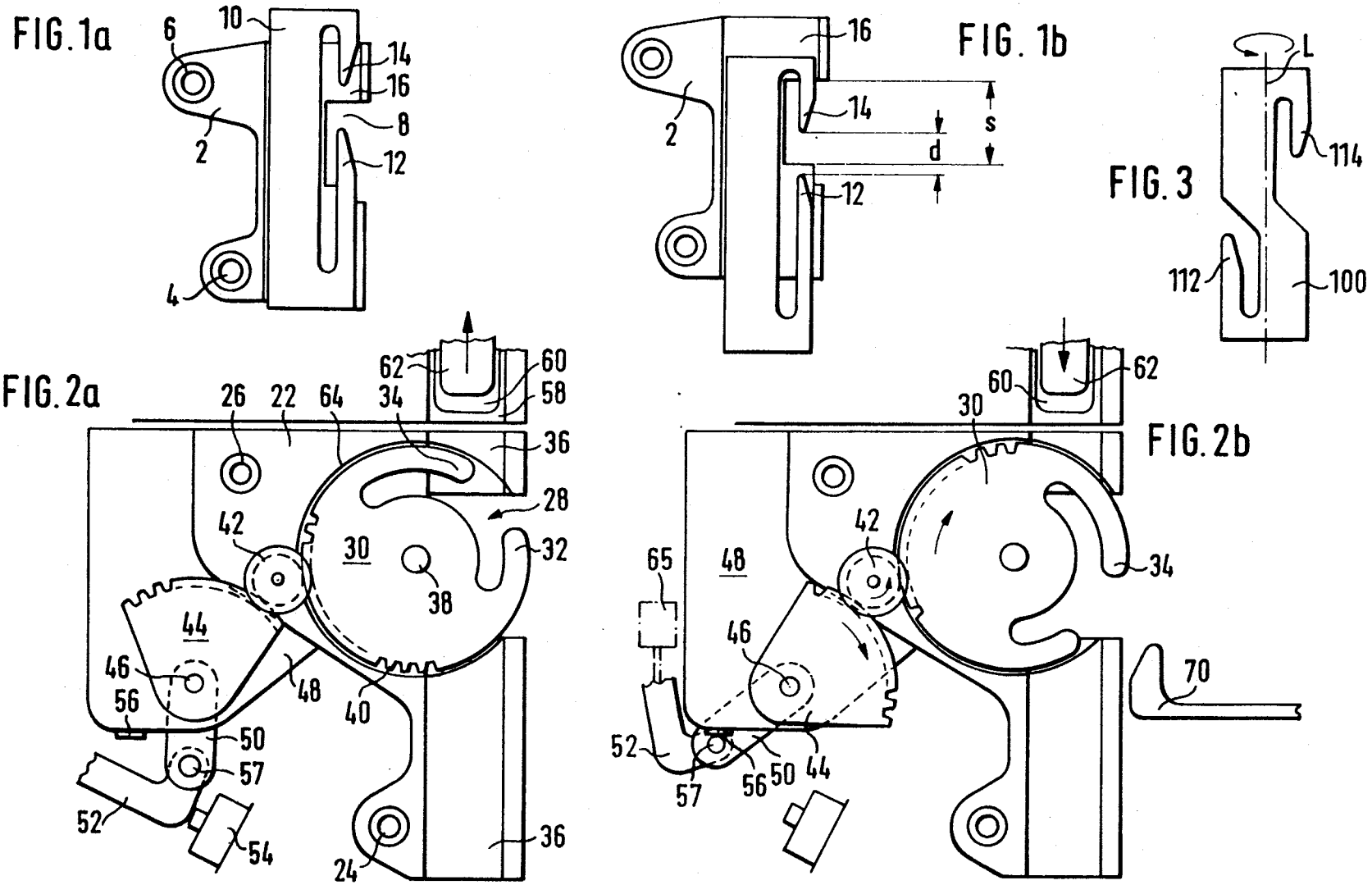
FIG. 1*a* shows a plan view of a needle plate comprising a tongue carrier for two chaining tongues, which is linearly displaceable with respect to said needle plate, and with the tongue carrier being shown in a position for forward sewing.
FIG. 1*b* shows a view similar to that of FIG. 1*a*, however with the tongue carrier being shown in a position for reverse sewing.
FIG. 2*a* shows a further embodiment of a needle plate comprising a tongue carrier for two chaining tongues together with an adjusting mechanism, with the tongue carrier being shown in a position for forward sewing.
FIG. 2*b* shows a view similar to that of FIG. 2*a*, however with the tongue carrier being shown in a position for reverse sewing.
FIG. 3 shows a third embodiment of a tongue carrier.

The construction of automatic sewing machines suitable for sewing loop or chain stitch seams is known per se and shall not be elucidated in more detail herein. The present case deals with an automatic sewing machine which is suitable for sewing so-called overlock or interlock seams. However, a further embodiment is suitable for flatlock seams as well.

The following description of embodiments is concentrated on the construction of the needle plate with the means and the feed of the sewing material which permit forward and reverse sewing of chain stitch seams.

According to FIG. 1*a*, a needle plate 2 can be mounted by means of two screw holes 4 and 6 on a machine housing of an automatic sewing machine in the region of the sewing material support. The needle plate 2 has a recess 8 within which the sewing needle moves below the plane of the needle plate.

The needle plate 2 comprises a guide way 16 in which a tongue carrier 10 is arranged in linearly movable manner. The tongue carrier 10 includes a (with respect to FIGS. 1*a* and 1*b*, upwardly directed) chaining tongue 12 for forward sewing and an oppositely directed chaining tongue 15 for reverse sewing. In FIG. 1*a* the chaining tongue 12 is located in the region of the recess 8 of the needle plate 2. In this position the chaining tongue 12 serves to form chaining loops during forward sewing.

For reverse sewing, the tongue carrier 10 is displaced into the position shown in FIG. 1*b*.

An adjusting mechanism which is not illustrated in more detail herein and which may be e.g. a lever linkage mechanism or the like, is used for the linear displacement of the tongue carrier 10 in the guide way 16 downwardly in the drawing, so that, according to FIG. 1*b*, the chaining tongue 14 for reverse sewing is located within the recess 8.

As can be seen from FIG. 1*b*, the facing apexes of the chaining tongues 12 and 14 are spaced from each other by a distance d which in the present embodiment is smaller than the length s of the recess 8 of the needle plate 2. As can be taken from FIGS. 1*a* and 1*b*, only one chaining tongue 12 or 14 at a time is located within the region of the recess 8 in the respective operational position of the tongue carrier 10.

FIGS. 2*a* and 2*b* show another embodiment of the invention which also renders possible to produce chain stitch seams by forward sewing and reverse sewing.

For attachment to the machine housing of the automatic sewing machine, a needle plate 22 (FIG. 2*a*) contains screw holes 24 and 26 and has—like the embodiment according to FIGS. 1*a* and 1*b*—a recess 28 through which the needle during sewing moves downwardly perpendicularly to the drawing plane. A tongue carrier 30, which is of disk-shaped configuration in this embodiment, contains in the peripheral portion thereof a chaining tongue 32 for forward sewing and a chaining tongue 34 for reverse sewing, the apexes thereof being spaced from each other by a similar distance as the chaining tongues 12 and 14 in the first embodiment.

The tongue carrier 30 is arranged in the needle plate 22 in recessed manner, the needle plate 22 having for this purpose a circular recess 64 with a diameter that is somewhat larger than the diameter of the tongue carrier 30. The top side of the tongue carrier 30 is located at a somewhat lower level than the top side of a guide way 36 whose function will still be elucidated hereinafter.

The tongue carrier 30 is rotably supported on a hinge pin 38. The tongue carrier 30 is formed in a peripheral section thereof with teeth in the form of a partial toothed rim 40. The teeth 40 mesh with an intermediate toothed wheel 42 which in turn is in engagement with a toothed segment 44 that is rotatably supported on a holding plate 48 by means of a hinge pin 46.

Via said hinge pin 46, the toothed segment 44 is rigidly coupled with a pivot lever 50 on the bottom side of holding plate 48. At the end of the pivot lever 50 facing away from hinge pin 46, the end of a knee lever 52 is pivotally connected thereto. The hinge pin 57 of pivot lever 50 and knee lever 52 constitutes a stop member 57.

In FIG. 2*a* the tongue carrier 30 is in a position for forward sewing of a chain stitch seam, in which the chaining tongue 32 for forward sewing is directed in the feeding direction of the sewing material.

In the present embodiment, the sewing material feeding means consists of a top-grip or gripper-type feed means comprising a lower gripping means 60 and an upper gripping means 62 whose end portions are shown in FIG. 2*a* at the top. The sewing material is clamped between lower gripping means 60 and upper gripping means 62 and is conveyed in the direction of the arrow. In doing so, the lower gripping means 60 moves through the guide way 36 in the region of the needle plate 22 and thereafter in a guide means 58 of the sewing material support.

The upper gripping means 62 is actuated e.g. by means of a pneumatically operated cylinder and is urged by the latter onto the lower gripping means 60 in order to clamp the sewing material therebetween.

In the condition according to FIG. 2*a*, the knee lever 52 assumes a stable position and, via the pivot lever 50, the toothed segment 44, the intermediate toothed wheel 42 and the teeth 40 in the tongue carrier 30, holds the latter and, consequently, the chaining tongue 32 for forward sewing formed thereon in a defined position for forward sewing. The knee lever 52 then rests on a stop 54.

In case a distance of reverse sewing is to be performed subsequently—e.g. for locking or sewing in a chain stitch seam end—, the machine control system is switched to reverse operation or, tiggered by a sensor, is automatically reversed. In response thereto, the knee lever 52 is moved obliquely upwardly in FIG. 2*b* in the direction of the arrow by means of a pneumatic cylinder 65, with the consequence that the toothed segment 44 is pivoted downwardly (arrow) in FIG. 2 via the pivot lever 50. The toothed segment 44 reaches a defined end position when the extension of the hinge pin between pivot lever 50 and knee lever 52, which serves as stop member 57, abuts a stop 56 mounted on the holding plate 48. By pivoting the toothed segment 44 downwardly, the intermediate toothed wheel 42 is rotated in counterclockwise direction, and consequently the tongue carrier 30 is rotated in clockwise direction. The chaining tongue 34 for reverse sewing thus reaches the operational position for reverse sewing shown in FIG. 2*b*. The gripper-type feed means 60, 62 is now moved downwardly in FIG. 2*b*, i.e. in reverse direction.

The gripper-type feed means 60, 62 is not shown in more detail in the drawings. The two gripping means 60 and 62 are members of ruler-like configuration and are moved by a common drive, e.g. a d.c. motor, on ball guides via toothed belts. This gripper-type feed means, whose lower gripping means is guided in the needle plate, permits an extremely neat seaming effect. The seam beginning and the seam end can be locked without any problem by means of a reversely sewn seam piece or by means of an additional piece of forward and reverse seam each.

The gripper-type feed means, according to its nature, is suitable only for feeding distances which are within certain limits. For greater feeding distances, the invention provides a top feed means integrated in the sewing foot of the machine. Such a top feed means is known per se. In the instant case, it serves merely for the feeding operation during forward sewing. During reverse sewing, the top feed means is turned off, and instead of the latter the gripper-type feed means is put into operation.

An edge cutting device, which is not shown in the drawing but always provided in automatic sewing machines for sewing chain stitch seams of the type in question here, is used for cutting the edges of the upper and the lower material to be sewn such that they are flush with each other. The edge cutting device comprises a lower knife and an upper knife which is moved in synchronism with the sewing cycle of the sewing needle. According to the invention, only the lower knife in the automatic sewing machine is mounted on the machine in movable manner; to be more precise, it is supported in retractable manner. This is of importance in reverse sewing, since then the lower knife is retracted by a pneumatic cylinder—which is effected automatically by the machine control system—, in order to prevent that the seam made so far is destroyed again by the edge cutting device during reverse sewing. The machine control system is an electronic control system which is known in principle and controls the individual functions of the machine.

A still further embodiment of the invention may have, instead of the linearly adjustable tongue carrier or the rotatable tongue carrier, a tongue carrier 100 according to FIG. 3, which is adapted to swivel around a longitudinal axis L and which brings either the chaining tongue 112 for forward sewing or the chaining tongue 114 for reverse sewing into the required operational position.

FIG. 3*b* shows an auxiliary chaining tongue 70 which is disposed above the needle plate and to the right of the sewing location and serves as a stitch forming member during reverse sewing.

I claim:

1. An automatic sewing machine for sewing chain stitch seams, said machine comprising:

a needle plate, feeding means for feeding sewing material in a forward direction and in a reverse direction, a first chaining tongue for cooperating with said needle plate and a needle in a forward sewing operation, said sewing operation involving the formation of chaining loops, said first chaining tongue facing in the forward direction, a second chaining tongue for use in a reverse sewing operation, and means for moving said first and second chaining tongues with respect to said needle plate.

2. An automatic sewing machine according to claim 1, wherein said machine comprises a tongue carrier, said tongue carrier comprising said first and second chaining tongues, said moving means comprising means for moving said tongue carrier.

3. An automatic sewing machine according to claim 2, wherein said tongue carrier (10) is linearly movably supported by said needle plate (2).

4. An automatic sewing machine according to claim 3, wherein said chaining tongues (12, 14) are linearly directed toward each other.

5. An automatic sewing machine according to claim 2, wherein said tongue carrier (30) is disk-shaped and rotatably supported by said needle plate (22), said tongue carrier being rotatable about an axis (38) which is perpendicular to the needle plate.

6. An automatic sewing machine according to claim 5, wherein said tongue carrier has a peripheral portion, and wherein said chaining tongue (32, 34) are located on said peripheral portion and have apexes which are spaced apart from each other.

7. An automatic sewing machine according to claim 6, further comprising a mechanism for actuating said tongue carrier (30), said actuating mechanism comprising a toothed gear (40, 42, 44) and linkage system (50, 52).

8. An automatic sewing machine according to claim 7, wherein said actuating mechanism comprises stops (54, 56) for defining operative positions for said chaining tongues.

9. An automatic sewing machine according to claim 2, wherein said needle plate has a recess for receiving said tongue carrier.

10. An automatic sewing machine according to claim 2, further comprising a guide way (58) for guiding said feeding means.

11. An automatic sewing machine according to claim 10, wherein said feeding means comprises an upper gripping means (62) and a lower gripping means (60), said lower gripping means being guided through said guide way.

12. An automatic sewing machine according to claim 2, further comprising an edge cutting device, said cutting device comprising an upper knife and a movable lower knife.

13. An automatic sewing machine according to claim 12, wherein said edge cutting device comprises means for retracting said lower knife during the reverse sewing operation.

* * * * *